US006393234B1

(12) United States Patent
Tashiro

(10) Patent No.: US 6,393,234 B1
(45) Date of Patent: May 21, 2002

(54) BOTTOM STRUCTURE OF IMAGE FORMING APPARATUS

(75) Inventor: Susumu Tashiro, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/651,668

(22) Filed: Aug. 30, 2000

(30) Foreign Application Priority Data

Aug. 31, 1999 (JP) ..... 11-245510

(51) Int. Cl.[7] ..... G03G 15/00
(52) U.S. Cl. ..... 399/107; 399/110
(58) Field of Search ..... 399/107, 108, 399/110

(56) References Cited

U.S. PATENT DOCUMENTS 5,191,382 A * 3/1993 Okamura et al. ..... 399/107
6,167,221 A * 12/2000 Kobayashi ..... 399/107

* cited by examiner

*Primary Examiner*—Arthur T. Grimley
*Assistant Examiner*—Hoang Ngo

(57) ABSTRACT

An image forming apparatus includes an image-bearing member, an image forming device for forming an image on the image-bearing member, a side section to substantially support at least one of the image-bearing member and the image forming device and a bottom section to support and position the side section. The bottom section includes an upper surface member, a lower surface member and a side surface member which connects each side of the upper surface member and each side of the lower surface member.

19 Claims, 6 Drawing Sheets

FIG. 2 ( a )
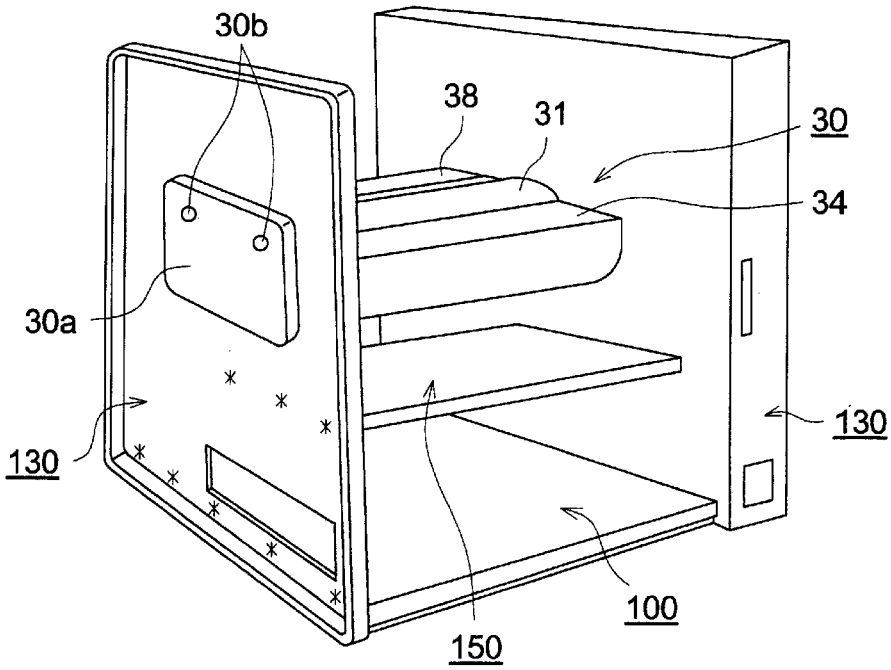
FIG. 2 ( b )
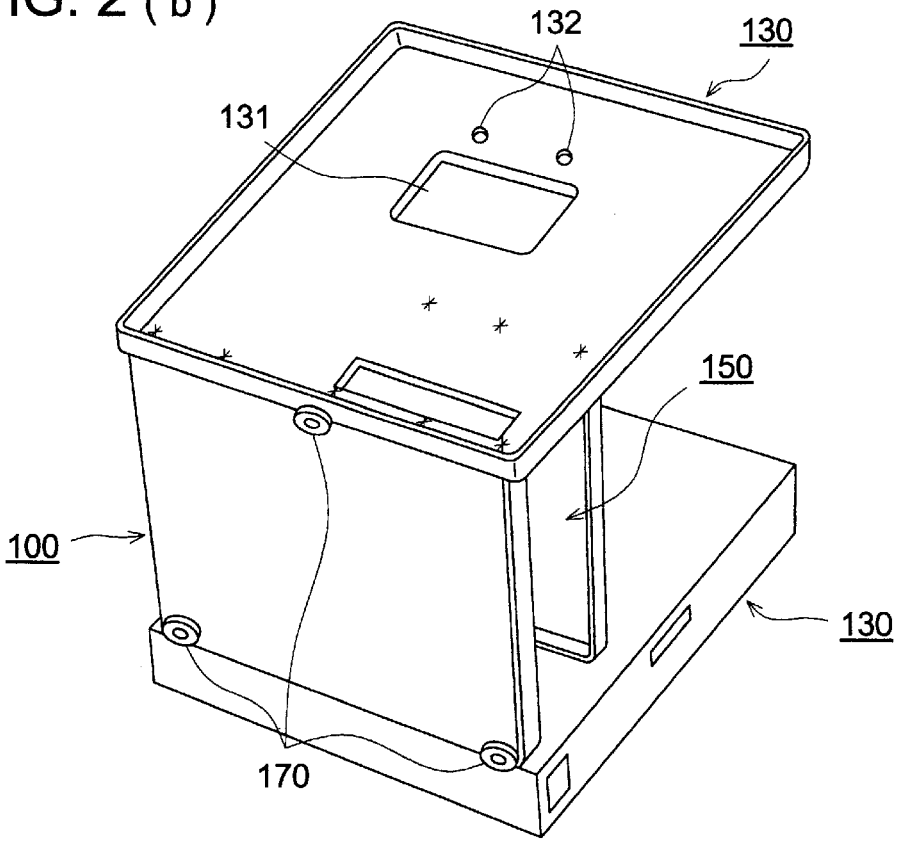

FIG. 3 ( a )
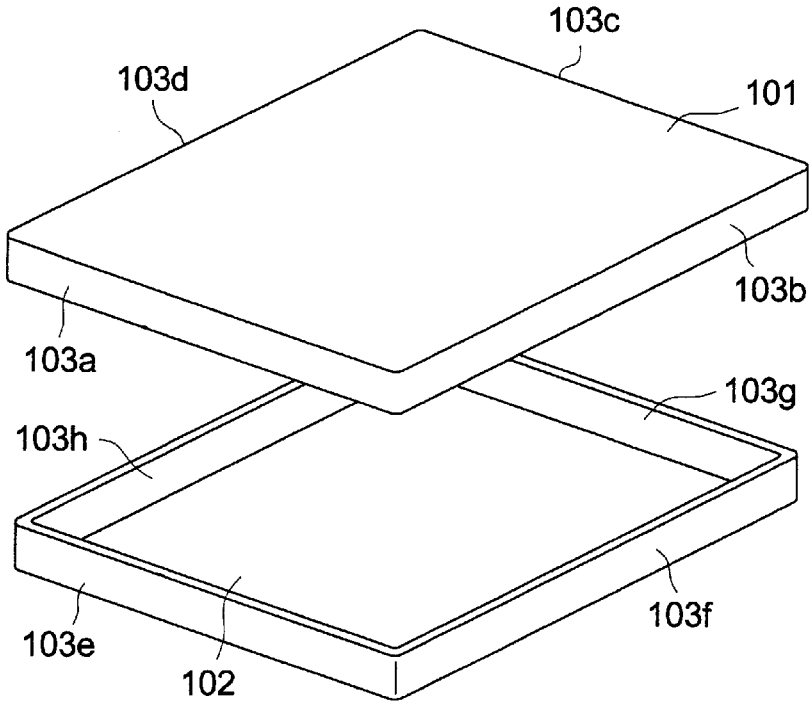
FIG. 3 ( b )
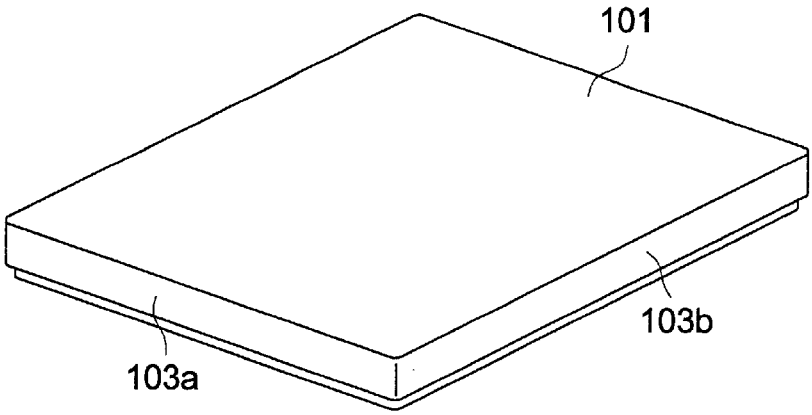

FIG. 4 ( a )
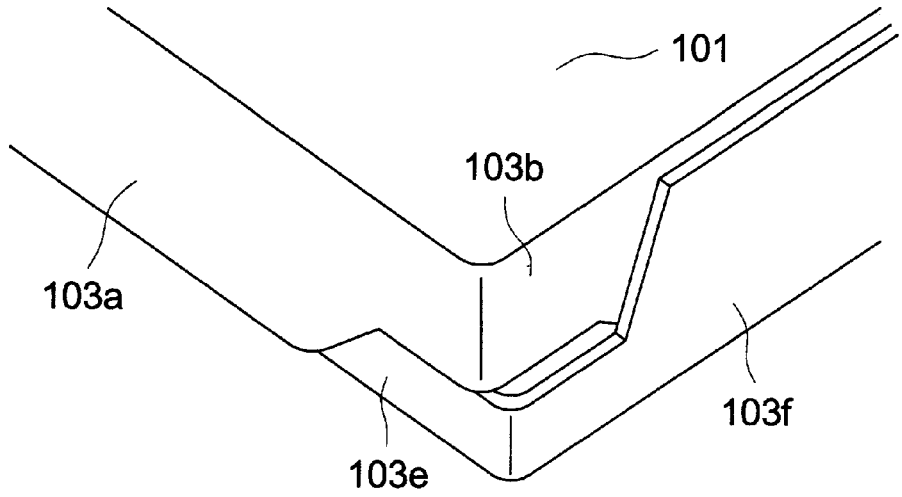
FIG. 4 ( b )
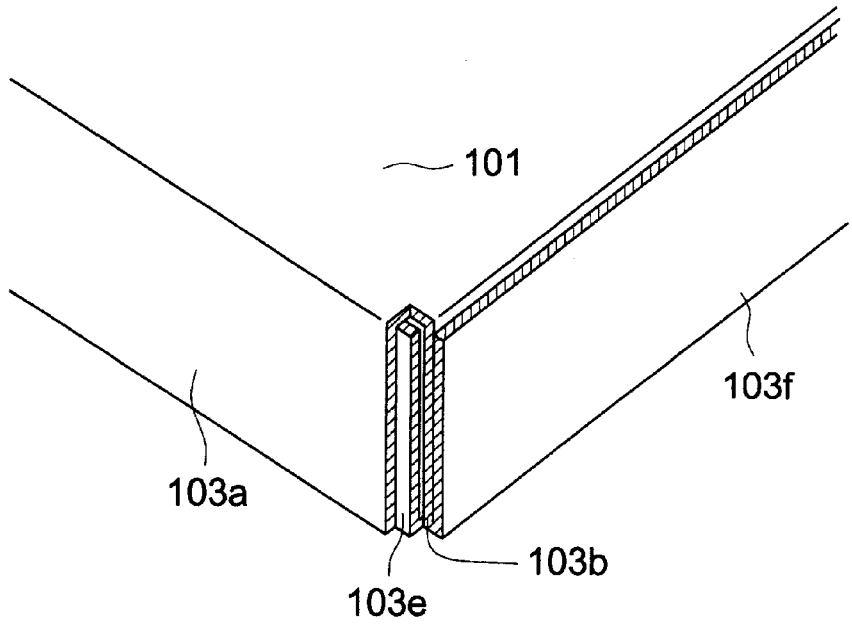

BOTTOM STRUCTURE OF IMAGE FORMING APPARATUS

BACKGROUND OF THE INVENTION

The present invention relates to an image forming apparatus, such as a printer, a facsimile, etc., and specifically relates to a bottom structure of the mainframe in the image forming apparatus.

Image forming apparatuses in which a toner image is formed on a transfer sheet by developing a latent image formed on a photoreceptor drum (serving as an image forming member) with developer containing toner and transferring and fixing the developed toner image on the transfer sheet are well known. Such image forming apparatuses employ an electro-photographic image forming method and include electro-photographic copies, printers, facsimiles, etc., so to speak.

According with the market demands, there has been proposed various methods to improve the quality of images produced by the image forming apparatus mentioned above. Among them, the method of hardening the stiffness of bottom structure of image forming apparatus mainframe has been proposed. Namely, distortion of the image forming apparatus mainframe due to the low stiffness of its bottom structure deviates relative positions of various kinds of members, which are incorporated in the mainframe, from normal positional relationships, resulting in deterioration of positional accuracy between them. Specifically, in the electro-photographic image forming apparatus, the relative positions between the photoreceptor element, exposure means and developing means should be strictly maintained in a constant distance with high accuracy, otherwise serious problems for image quality, such as distortion of images, difference of image density, etc., would occur. Especially, in a color image forming apparatus, a serious problem such as a slide of a plurality of color images (for instance, color images of Y (Yellow), M (Magenta), C (Cyan)) would occur.

Although, conventionally, it has been well known that hardening the stiffness of-the mainframe is effective and important to maintain the quality of images formed by the image forming apparatus, there have been little knowledge what kind of bottom structure is actually effective to harden the stiffness of the whole mainframe.

For instance, in a general-purpose image forming apparatus, a box-type bottom structure, which is formed by bending peripheral edge portions of a single metal sheet, as shown in FIG. 6, is employed, namely, a pan-type shape in which one of two wide surfaces of a rectangular parallelepiped is excluded. The stiffness of such type of bottom structure, however, is not high so much, since the wide surface is liable to easily flex.

Further, it is known that, in a specific image forming apparatus, a quadrilateral frame-type structure, which is formed by joining two bended square pipe steels, as shown in FIG. 7, has been employed for the bottom structure. Although the stiffness of such type of bottom structure is higher than that shown in FIG. 6, it is not sufficient for recent image forming apparatus, which are increasingly expected to produce images with higher accurate image quality than ever.

For instance, recently, a certain image forming apparatus, having a total weight of 200 kg–300 kg, has been put into market. In such image forming apparatus, one part of support member of its bottom section should support around 50 kg–70 kg as an average weight, which is substantially equivalent to a human's weight. Nonetheless, it is required such accuracy that the displacement, caused by the bending of bottom section, should be maintained within order of 100 $\mu$m.

SUMMARY OF THE INVENTION

To overcome the abovementioned drawbacks in conventional image forming apparatus, it is an object of the present invention to provide an image forming apparatus, which makes it possible to maintain a higher accurate image quality by strengthening the stiffness of the mainframe.

Accordingly, to overcome the cited shortcomings, the abovementioned object of the present invention can be attained by image forming apparatus described as follow.

(1) An image forming apparatus, which includes an image-bearing member and an image forming means for forming an image on the image-bearing member, comprising: a side section to substantially support at least one of the image-bearing member and the image forming means; and a bottom section to support and position the side section, wherein the bottom section comprises an upper surface member, a lower surface member and a side surface member which connects each side of the upper surface member and each side of the lower surface member.

(2) The image forming apparatus of item 1, wherein the image-bearing member is a photoreceptor element for bearing a latent image, and the image forming means comprises a exposure device for exposing an image so as to form a latent image on the photoreceptor element and a developing device for developing the latent image with toner contained in developer.

(3) The image forming apparatus of item 2, wherein the side section substantially supports the photoreceptor element.

(4) The image forming apparatus of item 2, further comprising: a transferring device for transferring a toner image developed by the developing device onto a transfer sheet; and a fixing device for fixing the toner image on the transfer sheet.

(5) The image forming apparatus of item 1, wherein the image forming means forms color images on the photoreceptor element.

(6) The image forming apparatus of item 1, wherein the bottom section comprises a hollow space formed between the upper surface member and the lower surface member.

(7) The image forming apparatus of item 1, wherein the bottom section is shaped in a rectangular parallelepiped.

(8) The image forming apparatus of item 1, wherein the bottom section is formed by combining more than two pan-type members, each of which is formed by bending a peripheral edge portion of a single metal sheet, and thereby, the bottom section is substantially comprised of the side surface member, which connects each side of the upper surface member and each side of the lower surface member.

(9) The image forming apparatus of item 8, wherein the pan-type members are combined each other by means of a welding process.

(10) The image forming apparatus of item 8, wherein the pan-type members are combined each other by means of an adhering process with adhesive.

(11) The image forming apparatus of item 1, wherein the bottom section and the side section are combined each other by means of a welding process.

(12) The image forming apparatus of item 1, wherein the bottom section further comprises three supporting members located at a bottom surface of the lower surface member to support the image forming apparatus.

(13) The image forming apparatus of item 2, wherein both edge portions of the photoreceptor element are supported by two of the side sections, each of which comprises a plurality of side members to support one of the edge portions in an axial direction of the photoreceptor element.

(14) The image forming apparatus of item 2, wherein at least one of the exposure device and at least one of the developing device are also positioned at the side section.

(15) The image forming apparatus of item 1, wherein a pan-type lower member, in which the lower surface member and the side surface member are formed by bending a single metal sheet, is combined with the upper surface member to form the bottom section.

(16) The image forming apparatus of item 15, wherein a pan-type upper member, in which the upper surface member and the side surface member are formed by bending a single metal sheet, is combined with the pan-type lower member, in which the lower surface member and the side surface member are formed by bending a single metal sheet, to form the bottom section.

(17) The image forming apparatus of item 16, wherein the side surface member of the bottom section is formed by overlapping the side surface member of the pan-type upper member and the side surface member of the pan-type lower member each other.

(18) The image forming apparatus of item 16, wherein the pan-type upper member is combined with the pan-type lower member by putting one of them in another, to form the bottom section.

(19) The image forming apparatus of item 1, wherein all side surface of the bottom section is substantially closed by the side surface member.

(20) The image forming apparatus of item 2, wherein the exposure device includes a laser-beam generator.

BRIEF DESCRIPTION OF THE DRAWINGS

Other objects and advantages of the present invention will become apparent upon reading the following detailed description and upon reference to the drawings in which:

FIG. 2(*a*) and FIG. 2(*b*) show perspective views of the image forming apparatus mainframe, illustrating a positional relation between the photoreceptor drum and the mainframe;

FIG. 3(*a*) and FIG. 3(*b*) show perspective views of an exemplified bottom structure embodied in the present invention;

FIG. 4(*a*) and FIG. 4(*b*) show illustrative views of corner portions of another exemplified bottom structures embodied in the present invention;

DETAILED DESCRIPTION OF THE PREFERRED EMBODIMENT

Referring drawings, an exemplified embodiment of the invention will be described in the following. The scope of the present invention, however, is not limited to following embodiment.

Figure 1:
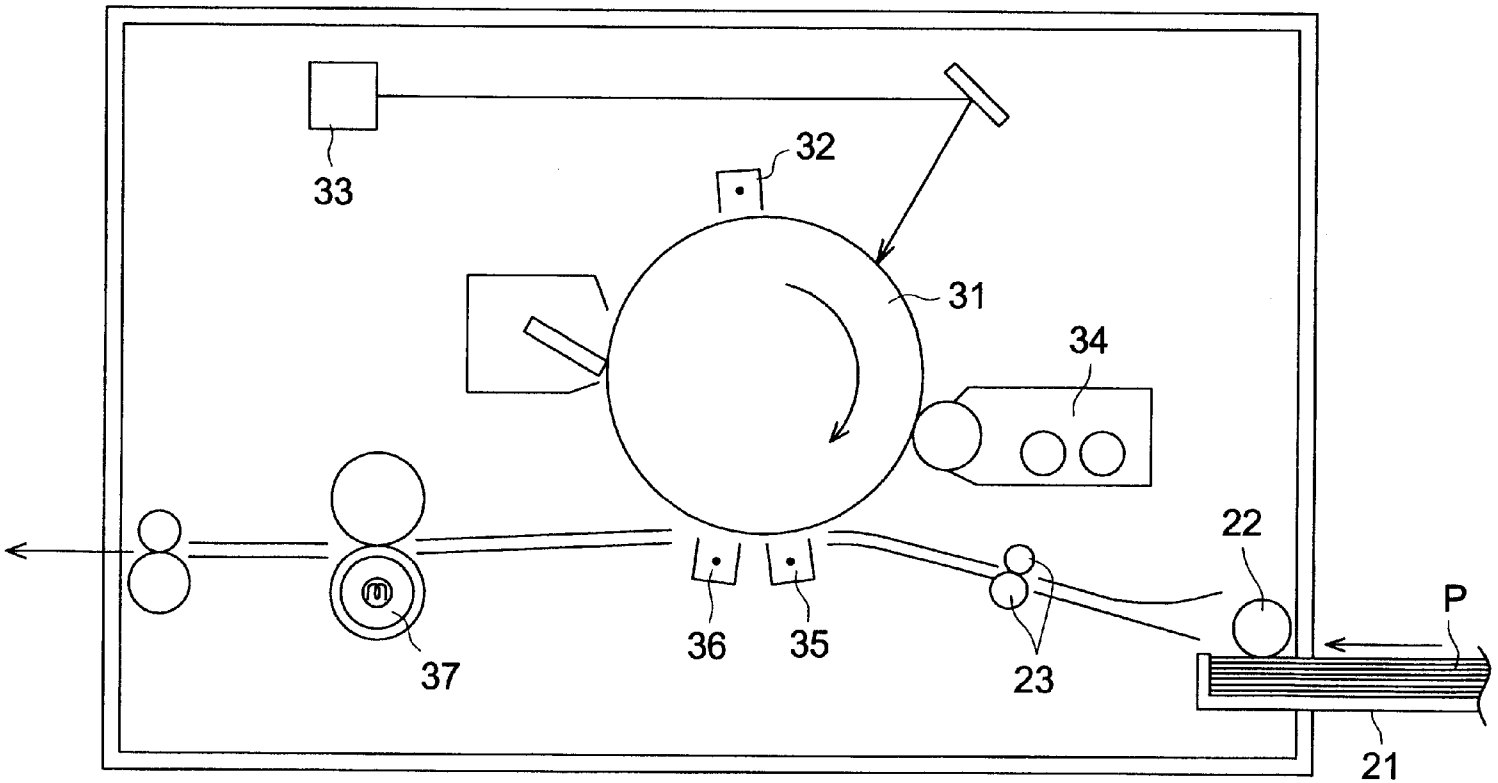
FIG. 1 shows a simplified cross-sectional view of a printer, serving as an image forming apparatus embodied in the present invention.

FIG. 1 shows a simplified cross-sectional view of a printer, serving as an image forming apparatus embodied in the present invention. The printer comprises sheet-feeding cassette 21 for storing transfer sheets P, sheet-feeding roller 22 for taking out transfer sheet P one by one from sheet-feeding cassette 21 and resist roller 23 for conveying transfer sheet P, fed by sheet-feeding roller 22, to photoreceptor drum 31, synchronizing with period Pt of the taking-out frequency of sheet-feeding roller 22. The photoreceptor drum 31 is driven to rotate in an arrow direction by means of a controller (not shown in the drawing). Charging means 32, exposing means 33, developing means 34, transferring means 35, separating means 36 and cleaning means 38 are arranged around the periphery of photoreceptor drum 31 in the above order from upstream. In this configuration, a toner image is formed on photoreceptor drum 31 through the processes of charging by charging means 32, exposing image by exposing means 33 (formation of a latent image), and developing by developing means 34, namely, formation of a real image by toner. Then, the toner image is onto transfer sheet P, conveyed by resist roller 23, by means of transferring means 35, and transfer sheet P separated from photoreceptor drum 31 by means of separating means 36. A pair of rollers of fixing means 37 fixes the toner image onto transfer sheet P, separated from photoreceptor drum 31, with heating and pressing actions. While, after separating transfer sheet P, the surface of photoreceptor drum 31 is cleaned by cleaning means 38 to be ready for next image formation. Each of means 31–38, which structure the image forming means, is controlled by the controller.

Incidentally; exposing means 33 includes means for emitting a laser beam and an optical system for focusing the laser beam onto photoreceptor drum 31. Alternatively, a LED (Light Emitting Diode) can be employed for the exposing means. For instance, in the color image forming apparatus, it is required that each LED for exposing each color should be strictly positioned opposite to the photoreceptor element with high accuracy.

FIG. 2(*a*) and FIG. 2(*b*) show perspective views of the image forming apparatus mainframe, illustrating a positional relation between the photoreceptor drum and the mainframe. The image forming apparatus mainframe comprises at least a bottom section and side section, which is connected to the bottom section and protrudes in the vertical direction. In FIG. 2(*a*) and FIG. 2(*b*), numeral 30 indicates a drum cartridge for holding and covering photoreceptor drum 31, developing means 34 and cleaning means 38, which are illustrated in FIG. 1. Numerals 100, 130, 150 and 170 indicate the bottom section serving as a part of the image forming apparatus mainframe, the side section connected to bottom section 100, a stay for reinforcing side section 130, and three support members, disposed at the bottom surface of the image forming apparatus, to support the whole weight of the image forming apparatus, respectively. Although there is no restriction for the shape of side section 130 as far as bottom section 100 can be mechanically connected to photoreceptor drum 31 by means of side section 130, it is desirable to employ a pan-type shape formed by bending peripheral edge portions of a quadrilateral metal sheet, as shown in FIGS. 2(*a*) and 2(*b*), in order to increase the stiffness of side section 130 while being lightweight. FIG. 2(*a*) shows a perspective view of the mainframe on which drum cartridge 30 is mounted, while FIG. 2(*b*) shows a perspective view of the mainframe only, viewing from the bottom side of the image forming apparatus. In the embodiment of the present invention, the mainframe is constructed by connecting the side portion of bottom section 100 to side section 130. Although there is no restriction for connecting methods between them, and welding, adhering with adhesive, etc. is available for this purpose; it is desirable to employ a welding connecting process in order to increase the stiffness of the connected portion, if the mainframe is made of metallic materials.

Incidentally, although it seems that fastening with screws can be employ for the connecting method between them, there is a possibility that the connecting method with screws would cause a displacement between them, when fastening screws to fix bottom section 100 and side section 130 each other. This displacement would result in an inclination of the bottom surface with respect to the horizontal surface, and would adversely affect the positional accuracy between the optical system and the photoreceptor element, which are fixed on the mainframe. Therefore, it is desirable that either welding or adhering with adhesive is employ for the connecting method, rather than fastening with screws.

Drum cartridge 30 is a kind of housing in which photoreceptor drum 31, developing means 34 and cleaning means 38 are mounted. Drum cartridge 30 is fixed to a side section 130 by inserting insertion member 30*a*, arranged at the end portion of drum cartridge 30, into insertion hole 131 of side section 130 of the mainframe and by inserting two positioning members 30*b*, formed on the inner side of insertion member 30*a*, into two positioning holes 132 bored on side section 130. Therefore, in the embodiment of the present invention, photoreceptor drum 31 is indirectly supported by side section 130 of the mainframe through insertion member 30*a*. In this structure, there is a possibility that drum cartridge 30 would be distorted by the torsion of side section 130, caused by the bending of the bottom section due to a stiffness of it. This fact would deteriorate the relative positioning accuracies between photoreceptor drum 31, developing means 34 and cleaning means 38, resulting in a deterioration of the image quality of images formed in the image forming apparatus.

As will be described in the following, however, according to the bottom structure of bottom section 100 embodied in the present invention, it becomes possible to prevent bottom section 100 from bending and to maintain the image quality in a good state.

The bottom section, embodied in the present invention, substantially comprises an upper surface, a lower surface and a side surface, which connect the upper surface and the lower surface. Namely, the above description means that, when the shapes of both the upper surface and the lower surface are quadrilateral, the bottom section is a rectangular parallelepiped, while, when the shapes of both the upper surface and the lower surface are circular, the bottom section is a cylindrical box. The meaning of "substantially comprises" in the above description is that holes, gaps or chips, residing on each surface due to manufacturing restrictions, are acceptable as far as those do not affects the stiffness of the bottom section to a considerable extent, though it is desirable that the bottom section of the present invention is a perfect solid covered by surfaces having neither holes, gaps nor chips. Concretely speaking, when outer surface area of the solid, having neither holes, gaps nor chips, is defined as 100, under a condition that the surfaces cover 70, more desirably 90, of outer surface area of the solid, the solid, serving as the bottom section embodied in the present invention, can maintain a sufficient stiffness. Further, it is desirable that the abovementioned "solid" is a hollow solid having an inner space between the upper surface and the lower surface. Such hollow solid make it possible to obtain a sufficient stiffness while being lightweight.

Figure 6:
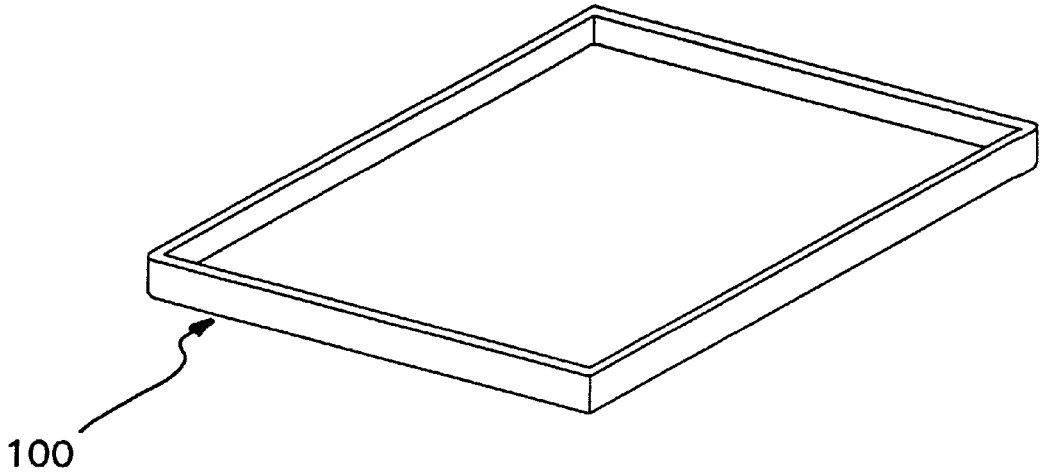
FIG. 6 shows a perspective view of an exemplified bottom structure utilized for conventional image forming apparatus.

FIG. 3(*a*) and FIG. 3(*b*) show perspective views of an exemplified bottom structure embodied in the present invention. Two pan-type members, each of which is formed by bending peripheral edge portions of a single metal sheet and faces each other, are put together to form the bottom section being a flat-box type. In other words, two conventional bottom sections, aforementioned referring to FIG. 6, are put together to form the bottom section. As shown in FIG. 3(*a*) and FIG. 3(*b*), the pan-type upper member, which comprises upper surface 101 and side surfaces 103*a*, 103*b*, 103*c*, 103*d* connected to upper surface 101, is overlapped on the pan-type lower member, which is next smaller size and comprises lower surface 102 and side surfaces 103*e*, 103*f*, 103*g*, 103*h* connected to lower surface 102, and then, overlapped upper and lower side surfaces are either welded or adhered with adhesive to construct the single bottom section.

The followings are advantageous points of the method of putting together the pan-type upper member and the pan-type lower member as described above. Namely, it requires much assembling cost to weld or adhere together members, each of which is separately cut out in advance, corresponding to each of all surfaces of the bottom section. In addition, displacements between members are increasingly liable to occur, and also disadvantageous for the strength of the bottom section. On the other hand, it may be possible to make the bottom section of a single metal sheet cut in a developed shape by bending each surface of it. In such method, however, it is difficult to insert a tool, employed for bending the last surface of the bottom section, into the inside of the box, resulting in a difficulty of accurate bending process.

While, according to the method, embodied in the present invention, in which the pan-type upper member and the pan-type lower member are put together, as shown in FIG. 3(*a*) and FIG. 3(*b*), it becomes possible to reduce man-hours for assembling the bottom section, advantageously resulting in its cost reduction. In addition, it is also possible to form upper and lower surfaces of the pan-type members without any distortions and to easily realize a high accuracy of the plane surface in the upper and lower surfaces only by putting together the pan-type members.

Specifically, when the side section, on which the photoreceptor element and other processing means for forming images are mounted, is attached to the bottom section of the flat-box type, as shown in FIG. 3(*b*), it is possible to easily heighten the positional accuracies between members necessary for forming images, due to the high accurate structure of the bottom section.

Further, according to the bottom structure shown in FIG. 3(*b*), it is also possible to improve the stiffness of the side surfaces of the bottom section, since the side surfaces are doubly reinforced by two sidewalls. Therefore, the bottom structure, embodied in the present invention, makes it easier to hold the side section, which support each of the abovementioned members, with the side surface of the bottom section and to heighten the positional accuracies.

FIG. 4(*a*) and FIG. 4(*b*) show illustrative views of corner portions of another exemplified bottom structures embodied in the present invention.

In the embodiment shown in FIG. 4(*a*), two pan-type upper and lower members, similar to those shown in FIG. 3, are put together to construct the single bottom section. The corner of the pan-type upper member is the cross portion of side surfaces 103*a* and 103*b*, while the corner of the pan-type lower member is the cross portion of side surfaces 103*e* and 103*f*. The half height of each corner portion of two pan-type upper and lower members is cut away to combine them in stagger state. Then, overlapped upper and lower side surfaces are either welded or adhered with adhesive to construct the single bottom section, as well as the embodiment shown in FIG. 3. In the embodiment shown in FIG. 4(*b*), two pan-type upper and lower members, similar to those shown in FIG. 3, are also put together to construct the single bottom section. The cross line portion of side surfaces 103*a* and 103*b*, and the cross line portion of side surfaces 103*e* and 103*f* are cut off, so that the pan-type upper and lower members fit each other to combine them in stagger state.

The iron plate (SECC-C-20/20) can be desirably employed for material of the bottom section. Bending amount δ, to be described later, can be reduced by increasing the second moment of area, concretely, by increasing the height of the side section, which connect the upper surface and lower surface of the bottom section, as high as possible. In addition, riveting method can be applied for fastening other members to the bottom section.

EMBODIMENT 1

Figure 5:
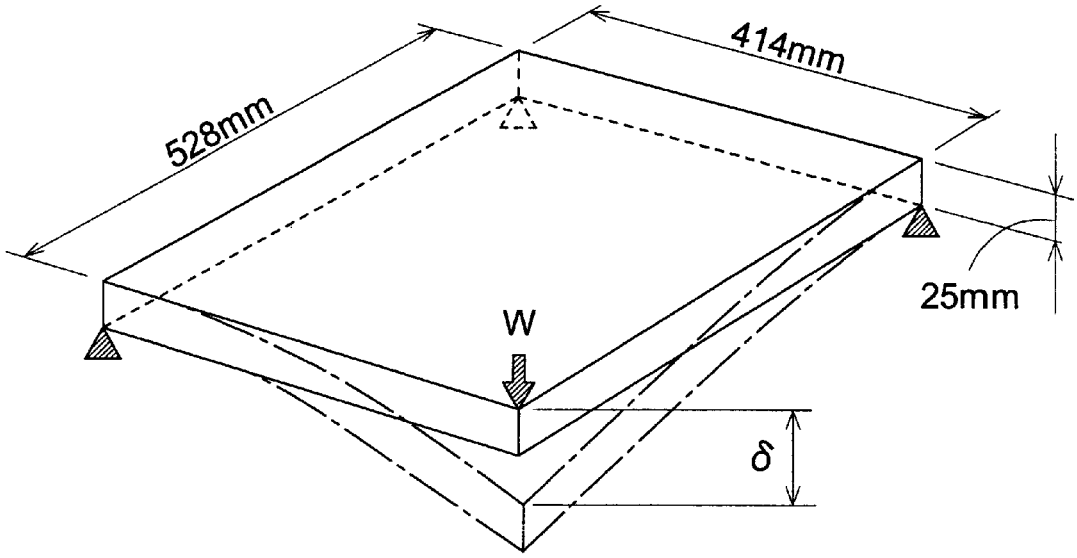
FIG. 5(*a*) shows an explanatory illustration in regard to outer dimensions of bottom structures and its bending amount, while FIG. 5(*b*) shows an evaluation result of the bending amount of each bottom structure in line graphs.
Figure 5:
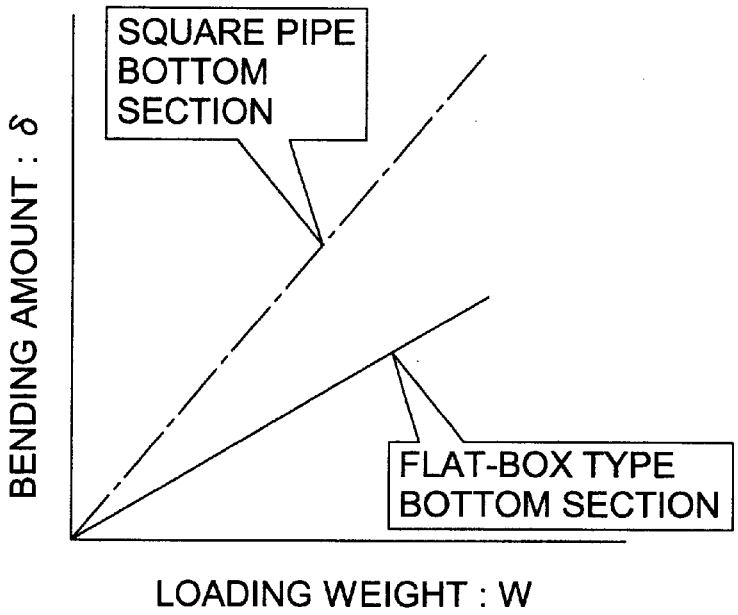
Figure 7:
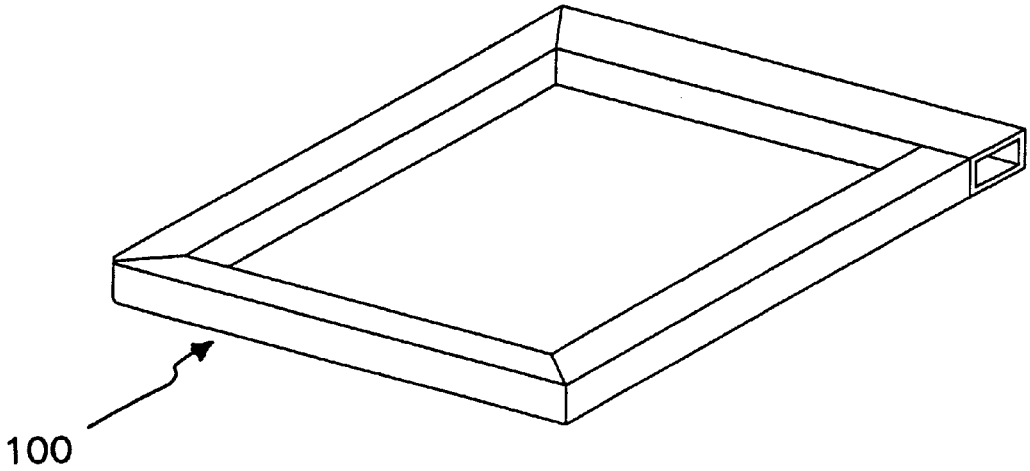
FIG. 7 shows a perspective view of another exemplified bottom structure utilized for conventional image forming apparatus.

With respect to the bottom structures having a height (side surface), such as a flat-box type bottom structure shown in FIG. 3 and a conventional square-pipe type structure shown in FIG. 7, FIG. 5(*b*) shows an evaluation result of bending amount δ of each bottom structure in line graphs. Outer dimensions of each bottom structure are unified as shown in FIG. 5(*a*).

A inch-size square-pipe of 25 mm×50 mm, which is popular in the marketplace, is employed for the mechanical members of the square-pipe type bottom section. The material of the square-pipe is STK (carbon steel hard tubes for structural purpose) and thickness of its plate is 1.6 mm. Both bottom structures are constructed by welding.

As shown in FIG. 5(*a*), bending amount δ, being under the evaluation, is defined as the vertical displacement (bending scale: mm) of the corner point of each bottom structure from the state with no load to the state with load W (kgf).

As is clear from the line graphs shown in FIG. 5(*b*), the bottom section having a flat-box type structure, embodied in the present invention, exhibits substantially twice as much stiffness as the conventional square-pipe type structure does.

The weight of the bottom section, employing the conventional square-pipe structure, is greater than around 10 kg, while it can be reduced less than 7 kg in the same outer dimensions when employing the bottom structure embodied in the present invention. Nonetheless, as shown in FIG. 5(*b*), bending amount δ of the bottom section, employing the conventional square-pipe structure, is twice of that of the present invention. Although it may be possible to increase the height of the square-pipe in order to reduce bending amount δ, it will further increase weight and thickness of the bottom section, resulting in a large-scale image forming apparatus.

As mentioned above, according to the bottom structure embodied in the present invention, the bending amount can be reduced by around half, compared to that of the conventional square-pipe structure, despite the fact that the weight of the bottom section can be also reduced by around half. Further, it becomes possible to heighten the stiffness of the mainframe by combining the side section, which supports the various members necessary for the image forming process, with the bottom section, and as a result, to provide an image forming apparatus in which a high accurate image quality can be maintained. Still further, it becomes possible to position the side section relative to the bottom section within an order of 100 μm, the total weight of the image forming apparatus is large.

What is claimed is:

1. An image-forming apparatus comprising:

an image-bearing member;

an image forming unit that forms an image on said image-bearing member; and a mainframe that firmly supports and positions said image-bearing member and said image forming unit, said mainframe comprising:

at least one side section that substantially supports at least one of said image-bearing member and said image forming unit, and a bottom section to which said at least one side section is rigidly connected, said bottom section including an upper surface member, a lower surface member and at least one side surface member;

wherein said at least one side surface member is rigidly connected to circumferential edge portions of both said upper surface member and said lower surface member to form a hollow space in the interior of said bottom section.

2. The image forming apparatus of claim 1, wherein said image-bearing member is a photoreceptor element for bearing a latent image, and said image forming unit comprises an exposure device for exposing an image so as to form a latent image on said photoreceptor element and a developing device for developing said latent image with toner contained in developer.

3. The image forming apparatus of claim 2, wherein said side section substantially supports said photoreceptor element.

4. The image forming apparatus of claim 2, further comprising:

a transferring device for transferring a toner image developed by said developing device onto a transfer sheet; and a fixing device for fixing said toner image on said transfer sheet.

5. The image forming apparatus of claim 2, wherein said at least one side section comprises two side sections, and respective edge portions of said photoreceptor element are supported by said side sections, each of which comprises a plurality of side members to support one of said edge portions in an axial direction of said photoreceptor element.

6. The image forming apparatus of claim 2, wherein at least one of said exposure device and said developing device is positioned on said side section.

7. The image forming apparatus of claim 2, wherein said exposure device includes a laser-beam generator.

8. The image forming apparatus of claim 1, wherein said image forming means forms color images on said photoreceptor element.

9. The image forming apparatus of claim 1, wherein said bottom section is shaped in a rectangular parallelepiped.

10. The image forming apparatus of claim 1, wherein said bottom section is formed by combining at least two pan-type members, each of which is formed by bending a peripheral edge area of a single metal sheet.

11. The image forming apparatus of claim 10, wherein said pan-type members are connected to each other by welding.

12. The image forming apparatus of claim 10, wherein said pan-type members are connected to each other by adhesive.

13. The image forming apparatus of claim 1, wherein said bottom section and said side section are connected to each other by welding.

14. The image forming apparatus of claim 1, wherein said bottom section further comprises three supporting members located at a bottom surface of said lower surface member to support said image forming apparatus.

15. The image forming apparatus of claim 1, wherein a pan-type lower member, in which said lower surface member and said at least one side surface member are formed by bending a single metal sheet, is combined with said upper surface member to form said bottom section.

16. The image forming apparatus of claim 15, wherein a pan-type upper member, in which said upper surface member and at least one said side surface member are formed by bending a single metal sheet, is combined with said pan-type lower member, in which said lower surface member and at least one said side surface member are formed by bending a single metal sheet, to form said bottom section.

17. The image forming apparatus of claim 16, wherein said at least one side surface member of said bottom section is formed by overlapping said at least one side surface member of said pan-type upper member and said at least one side surface member of said pan-type lower member with each other.

18. The image forming apparatus of claim 16, wherein said pan-type upper member is combined with said pan-type lower member by putting one of them inside the other to form said bottom section.

19. The image forming apparatus of claim 1, wherein all side surfaces of said bottom section are substantially closed by said at least one side surface member.

* * * * *